United States Patent [19]

Farlotti

[11] Patent Number: 4,856,770

[45] Date of Patent: Aug. 15, 1989

[54] PRESSURE WHEEL DEVICE FOR MOVING A PRINT MEDIUM IN A PLOTTER OR PRINTER

[75] Inventor: Laurent A. Farlotti, Maisons Alfort, France

[73] Assignee: Benson S.A., France

[21] Appl. No.: 691

[22] Filed: Jan. 6, 1987

[30] Foreign Application Priority Data

Jan. 17, 1986 [FR] France ..... 86 00637

[51] Int. Cl.[4] ..... B65H 5/06

[52] U.S. Cl. ..... 271/274; 226/187

[58] Field of Search ..... 271/272, 274; 226/176, 226/177, 187

[56] References Cited

U.S. PATENT DOCUMENTS

| | | | |
|---|---|---|---|
| 1,921,167 | 8/1933 | Perry | 271/50 |
| 2,461,376 | 2/1949 | Feldmeier | 271/52 |
| 2,995,363 | 8/1961 | Pittwood | 271/51 |
| 3,067,999 | 12/1962 | Skeen | 271/51 |
| 3,532,338 | 10/1970 | Brinson et al. | 271/53 |
| 3,618,934 | 11/1971 | Germuska | 271/274 |
| 4,000,762 | 1/1977 | Mizuno | 139/452 |
| 4,272,069 | 6/1981 | Matthews | 271/182 |
| 4,448,407 | 5/1984 | Bashford et al. | 271/8 A |
| 4,482,148 | 11/1984 | Stewart, Jr. | 271/273 |
| 4,522,520 | 6/1985 | Takenoya | 271/274 X |
| 4,625,955 | 12/1986 | Snellman | 271/274 X |
| 4,629,177 | 12/1986 | Roddeman | 226/187 X |

FOREIGN PATENT DOCUMENTS

| | | | |
|---|---|---|---|
| 1296688 | 5/1961 | France . | |
| 1390022 | 4/1964 | France . | |
| 1419302 | 12/1964 | France . | |
| 1449626 | 3/1965 | France . | |
| 1499172 | 6/1966 | France . | |
| 1603699 | 6/1971 | France . | |
| 2221282 | 10/1974 | France . | |
| 2384623 | 10/1978 | France . | |
| 2513782 | 4/1983 | France . | |
| 2525576 | 10/1983 | France . | |
| 22239 | 2/1983 | Japan | 271/274 |
| 849421 | 9/1960 | United Kingdom | 271/274 |

OTHER PUBLICATIONS

D. C. Estabrooks et al., "Nip Roller/Force Equalizing Assembly," *IBM Technical Disclosure Bulletin,* (Aug. 1980), vol. 23, No. 3.

*Primary Examiner*—Richard A. Schacher

*Attorney, Agent, or Firm*—David H. Carroll; Robert C. Colwell; Vernon A. Norviel

[57] ABSTRACT

Two pressure wheels are mounted on respective support parts and are pressed against respective edges of print medium by a common force-applying device such as a cable acting substantially equally on two mechanical devices on which the pressure wheels are mounted in order to transmit substantially identical forces thereto; each wheel may be mounted at one end of a lever which is hinged to the corresponding support part and which supports a pulley over which the cable passes.

9 Claims, 1 Drawing Sheet

F1
F2

PRESSURE WHEEL DEVICE FOR MOVING A PRINT MEDIUM IN A PLOTTER OR PRINTER

BACKGROUND OF THE INVENTION

1. Field of the Invention

The present invention relates to a pressure wheel device in a drive system for print medium in a printing machine. More particularly, the invention relates to such a device of the type comprising two pressure wheels mounted on respective support parts together with means for pressing each of the wheels against a respective edge of a print medium.

2. Description of the Prior Art

A field in which the invention is particularly, but not exclusively, applicable is printing or plotting machines in which a strip of paper or other printing media is moved by being pressed against a drive roller.

Devices of the above type are known in which each pressure wheel is associated with its own resilient device, and is optionally provided with an electrical or electromagnetic control for putting the wheel under pressure. In such known devices, it is practically impossible to equalize the pressure exerted by the pressure wheels on the print medium. The difference between the applied pressures of two or more wheels then may cause the print medium to slip in a zig-zag manner while being moved, thereby spoiling the printing being performed or the image being plotted.

SUMMARY OF THE INVENTION

The invention of provides a pressure wheel device which overcomes the above disadvantages while still being capable, where applicable, of adapting easily to different sizes of print medium.

This aim is achieved by means of a device in which the pressure wheels are put under pressure by a common force-applying means acting substantially equally on two mechanical devices on which the pressure wheels are mounted, thereby transmitting substantially identical forces thereto.

Each pressure wheel is preferably mounted at one end of a lever which is hinged to the corresponding support part and which bears a pulley wheel. The common force-applying means, in one embodiment, constitutes a cable or the like which passes over the pulleys, together with means for putting the cable under tension to exert forces on the pulleys. The equal forces are transmitted to the pressure wheels by the levers.

Since the pressure wheels are mounted on their supports in an identical manner, or at least in mechanically equivalent manners, the tension in the cable is applied substantially equally to both wheels. The cable tension may be produced by a spring fixed at one end thereof so that its elongation determines the tension applied to the cable. The desired result, namely the application of equal pressure to the wheels, is thus obtained by means which are both simple and inexpensive.

Each support part may carry two return pulleys over which the cable passes, which return pulleys are located on either side of the pulley carried by the lever. The three pulleys then constitute a pulley block capable of amplifying the cable tension for application to the lever. The lever may also have an amplifying effect to apply to the wheel a greater force than that exerted on the pulley by the cable.

Other features and advantages of a device in accordance with the invention will be evident from reading the following description which is given by way of nonlimiting example and with reference to the accompanying drawings.

DETAILED DESCRIPTION OF THE PREFERRED EMBODIMENT

Figures 1, 2, 3, 4:
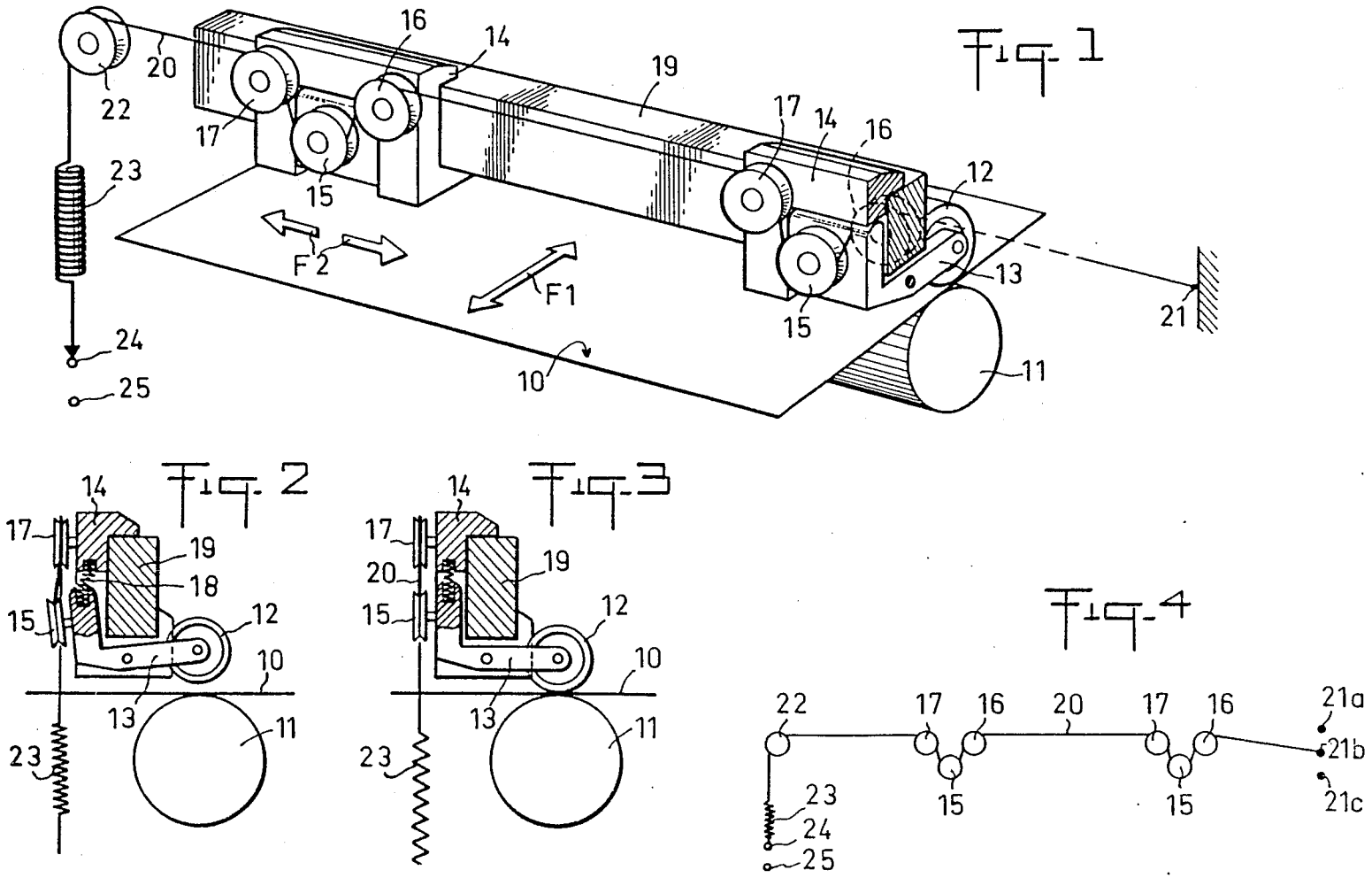
FIG. 1 is a simplified perspective view of an embodiment of a pressure wheel device in accordance with the invention.
FIGS. 2 and 3 are simplified partial sections showing a pressure wheel respectively in a raised position and in a lowered position.
FIG. 4 is a diagram showing a variant mounting for the tension-applying cable, enabling the force applied to the pressure wheels to be modulated.

FIG. 1 is a perspective view of a system for driving a sheet 10 in a printing machine, for example, a plotter. As is known, the sheet is driven one way or the other (arrow F1) in a longitudinal direction by means of a drive roller 11 against which the sheet 10 is pressed, and which has at least a portion of its periphery fabricated from material with a high coefficient of friction. The roller 11 is coupled to a motor (not shown).

The sheet 10 is pressed against the roller by means of two pressure wheels 12 which press against the sheet 10 in the vicinity of respective edges thereof. As can be seen in FIGS. 1 to 3, each pressure wheel 12 is free to rotate about a horizontal axis parallel to the axis of the roller 11. The wheels 12 are mounted between the two arms of a fork made in a first end of a lever 13. Each lever 13 is mounted on an axis between its first end and its second end to a respective carriage 14 in such a manner as to be able to pivot about axis, which is parallel to the axis of pressure wheel 12. The second end of each lever is L-shaped and carries a pulley 15 capable of rotating about an axis which is substantially horizontal and perpendicular to the axis of pressure wheel 12. Two return pulleys 16 and 17 are mounted on the carriage 14 with their axes parallel to the axis of the pulley 15, and they are located in substantially the same plane as the pulley 15. The pulleys 16 and 17 are situated at a higher level than the pulley 15 on both sides thereof.

Typically, the two pressure wheel mountings are identical, and the carriages 14 which carry them are mounted on a rail 19 extending parallel to the axis of the roller 11. The positions of the wheels 12 may be adapted to the format of a given sheet of print media simply by adjusting the distance between the carriages 14 by sliding one and/or the other along the rail 19 (arrows F2).

A nonextensible cable 20 is fixed at a first end to a point 21 to one side of the drive system on the frame of the machine. The cable then passes over the pulleys 16, 15, and 17 in succession on the first carriage and then on the second carriage, then passes over a return pulley 22. The opposite end of the cable is fixed to a tension-applying spring 23. The cable 20 lies in a plane extending parallel to the axis of the roller. The opposite end of the spring 23 not connected to the cable 20 will be fixed to one of two points 24 or 25. If fixed to point 24, the spring is not under tension or is under little tension. If fixed to anchor point 25, the spring is extended and exerts a tension force F on the cable.

When the cable 20 is free (spring 23 slack and fixed to the rest point 24), the wheels 12 are moved to a raised position (FIG. 2) by springs 18 (only visible in FIGS. 2 and 3) mounted in the carriages 14 and acting on the levers 13. In this position, the wheels 12 provide an unencumbered passage for inserting a sheet into the plotter Also, when the wheels 12 are raised, it is possible to adjust the distance between the carriages 14 match the width of the inserted sheet.

When the cable 20 is put under tension (spring 23 taut and fixed to working point 25), the wheels 12 are moved to a low position against the return force exerted by the springs 18. The tension force F in the cable is applied equally to both carriages, thereby ensuring via the pulleys 15 and the levers 13 that equal pressures are applied by the wheels 12. In the preferred embodiment, the multiplying effect provided by the blocks of pulleys 15, 16, and 17 on each carriage provides a first stage of amplification of the tension force F, with a coefficient equal to about 2. The lever 13 provides additional force amplification, for example, it too may have a coefficient of about 2, thereby causing the force with which each pressure wheel is pressed against the sheet to be about 4F. Because the two carriages are the same size, and cable 10 is common to both, the pressure applied to the media is substantially the same at both wheels. The effects of dispersions in the parts due to manufacturing tolerances, and of residual bending in the rail 19, which could cause variations in the heights of the carriages 14, are almost totally self-compensated. Furthermore, when the cable is under tension, the resultant force exerted by the carriages 14 on the rail 19 due to the reactive forces from the pulleys serves to hold the carriages fast while the sheet moves during printing, by virtue of the coefficient of friction between the carriages and the rail.

The invention makes it possible to provide a pressure wheel device in which the separation between the pressure wheels is adjustable and in which equal pressures are exerted by the wheels. The device is simple to construct and easy to use, both when adjusting the separation between the wheels and when raising them to insert a sheet into the machine.

An additional advantage of the invention is the ease with which it may be adapted to modulating the pressure exerted by the pressure wheels. In particular, it is desirable generally to reduce the wheel pressure force for sheet formats smaller than the maximum format, thereby reducing bending in the drive roller when the wheel thrust points are located farther from the support bearings of the roller.

The reduction in force may be simply achieved by changing the position of the point 21 at which the first end of the cable 20 is attached, as shown in FIG. 4. In the example shown, three points of attachment 21*a*, 21*b*, and 21*c* are provided, with the paths between the anchor point 25 and these three points of attachment being different. Each of these points of attachment would be associated with a particular format for the sheet 10. Naturally, it also would be possible to provide a plurality of anchor points for the end of the spring 23, with different points corresponding to different spring elongations, and therefore different pressure wheel forces.

In either case, the tension F may be automatically adapted to the sheet format by controlling the position of the cable point of attachment or of the spring anchor point as a function of a signal produced by a well-known device which automatically recognizes the width of the sheet.

I claim:

1. A pressure wheel device for a system for driving a print medium, said device comprising at least two pressure wheels mounted on respective support parts together with means for pressing each of the wheels against selected portions of the print medium, characterized by said wheels being put under pressure by common force-applying means acting substantially equally on at least two mechanical devices on which the pressure wheels are mounted, thereby transmitting substantially identical forces thereto, that each wheel is mounted at one end of a lever hinged to the corresponding support part, and that each lever carries a pulley and the common force applying means comprises a cable which passes over the pulleys together with means for putting the cable under tension to exert forces on the pulleys which forces are transmitted to the pressure wheels by the levers.

2. A device according to claim 1 characterized in that the means for putting the cable under tension is capable of passing between a rest state in which the wheels occupy a raised position under the effect of return springs acting against the levers, and a working state in which the wheels are applied against the print medium under the action of the tension in the cable acting against the return springs.

3. A device according to claim 2 characterized in that the return springs maintain residual tension in the cable when the means for putting the cable under tension is in its rest state.

4. A device according to claim 2 characterized in that the tension exerted on the cable may be changed to suit the print medium.

5. A device according to claim 1 characterized in that the means for putting the cable under tension comprises a spring fixed to one end of the cable and the elongation of the spring determines the tension.

6. A device according to claim 3 characterized in that the means for putting the cable under tension comprises a spring fixed to one end of the cable and the elongation of the spring determines the tension.

7. A device according to claim 6 characterized in that the tension exerted on the cable is adjustable.

8. A pressure wheel device for a system for driving a print medium, said device comprising at least two pressure wheels mounted on respective support parts together with means for pressing each of the wheels against selected portions of the print medium, characterized by said wheels being put under pressure by common force-applying means acting substantially equally on at least two mechanical devices on which the pressure wheels are mounted, thereby transmitting substantially identical forces thereto, and that the supports parts are in the form of carriages capable of sliding along a transverse rail to enable adjustment of distance between the pressure wheels.

9. A device according to claim 8 characterized in that the carriages are held in position on the rail during printing by force exerted on the rail as a reaction to pressure force applied by the wheels.

* * * * *